United States Patent [19]

Kay et al.

[11] 4,456,124

[45] Jun. 26, 1984

[54] COMBINATION COSMETIC CONTAINER AND SUPPORT ARRANGEMENT AND METHOD OF ASSEMBLY

[75] Inventors: Nathan Kay; Robin M. Kay, both of Encino, Calif.

[73] Assignee: Max Factor & Co., Hollywood, Calif.

[21] Appl. No.: 441,305

[22] Filed: Nov. 12, 1982

Related U.S. Application Data

[63] Continuation of Ser. No. 221,298, Dec. 30, 1980, abandoned.

[51] Int. Cl.[3] ..... B65D 73/00

[52] U.S. Cl. ..... 206/463; 206/470

[58] Field of Search ..... 206/462, 463, 470, 486, 206/806

[56] References Cited

U.S. PATENT DOCUMENTS

| | | | |
|---|---|---|---|
| 2,931,493 | 4/1960 | Pfohl | 206/462 |
| 2,998,131 | 8/1961 | Irvin, Jr. | 206/463 |
| 3,111,220 | 11/1963 | Bostrom | 206/462 |
| 3,179,246 | 4/1965 | Rosenburg, Jr. | 206/462 |
| 3,463,309 | 8/1969 | Szostek | 206/470 |
| 3,811,563 | 5/1974 | Fox | 206/461 |

FOREIGN PATENT DOCUMENTS

| | | | |
|---|---|---|---|
| 2025766 | 1/1980 | United Kingdom | 206/462 |

*Primary Examiner*—Joseph Man-Fu Moy

*Attorney, Agent, or Firm*—Flehr, Hohbach, Test, Albritton & Herbert

[57] ABSTRACT

A combination cosmetic container and support arrangement is disclosed herein along with a particular way in which it is assembled. The container itself includes a main section defining a compartment adapted to house a cosmetic therein and a cooperating lid. The combination arrangement also includes a support tab having a sheet-like main body which includes a cutout configured to accommodate the container. More specifically, the container with its lid closed is supported within the cutout such that at least one edge section of the tab body along the cutout extends into and between the container's main section and closed lid for maintaining the container in place. The entire tab and its supported container may be hung from a shelf peg or the like by means of a cooperating through-hole in the tab's main body.

2 Claims, 8 Drawing Figures

COMBINATION COSMETIC CONTAINER AND SUPPORT ARRANGEMENT AND METHOD OF ASSEMBLY

This is a continuation, of application Ser. No. 221,298 filed Dec. 30, 1980, now abandoned.

The present invention relates generally to cosmetic (make-up) containers for blush, eye shadow, lipstick, compacts and the like and more particularly to a specific technique for packaging these containers and supporting the latter on a display rack, shelf peg or the like.

Heretofore, it has been common practice to package cosmetic products of the type recited above in blister type packaging. While this type of packaging approach is generally satisfactory, it is a primary object of the present invention to provide a more economical packaging technique and specifically one which supports and displays a cosmetic container in an uncomplicated, attractive and readily visible fashion.

As will be seen hereinafter, the specific packaging technique disclosed herein is one which utilizes a support tab in combination with the cosmetic container to be packaged. The support tab is comprised of a sheet-like main body which includes a cutout configured to accommodate the container. The entire container is disposed within the cutout such that at least one edge section of the tab body along the cutout extends into and is interlocked with the container for maintaining the latter in place. In the specific embodiment disclosed herein, the container includes a main section defining a compartment adapted to house a cosmetic therein, for example the blush, eye shadow or the like recited above, and a lid which cooperates with the main section for opening and closing the compartment. This container with its lid closed is supported within the cutout such that confronting edge sections of the tab body along opposite edges of the cutout extend into and between the container's main section and closed lid. This combination container and tab may be supported to a hook or peg forming part of a display rack or shelf utilizing a cooperating through-hole which may be readily provided in the tab just above its cutout. In this way, the tab alone serves as a package and a support for its associated cosmetic container in an economical and uncomplicated way while, at the same time, placing most of the container in direct view, e.g. uncovered, for visual inspection by potential customers.

The combination cosmetic container and support arrangement just described generally will be discussed in more detail hereinafter in conjunction with the drawings wherein.

Figure 1:
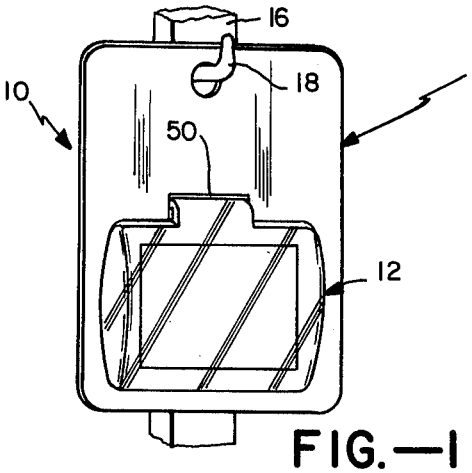
FIG. 1 is a perspective view of the combination arrangement shown supported to a shelf or display rack.
Figure 2:
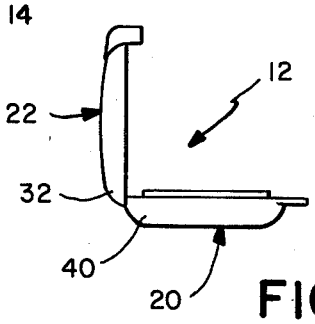
FIG. 2 is a side elevational view of the cosmetic container comprising part of the overall combination arrangement of FIG. 1, the container being shown in its opened position.
Figure 7:
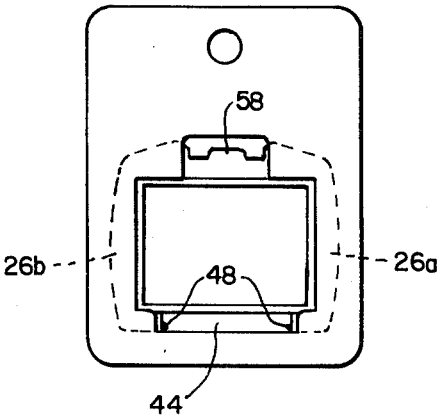
Figure 8:
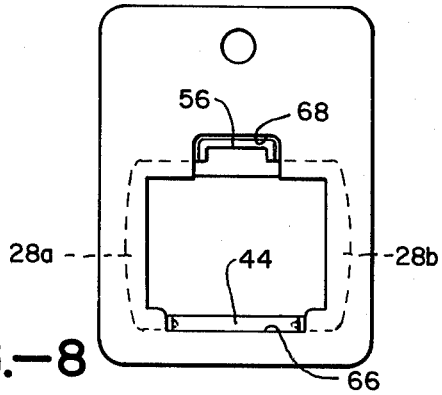

FIG. 7 is a front elevational view of the combination arrangement of FIG. 1 with a front portion of the container removed to show how the tab and a back portion of the container cooperate with one another; and FIG. 8 is a back elevational view of the combination arrangement of FIG. 1 with a back portion of the container removed to show how the tab support and a front portion of the container cooperate with one another.

Turning now to the drawings, wherein like components are designated by like reference numerals throughout the various figures, attention is first directed to FIG. 1. This figure illustrates a combination cosmetic container and support arrangement which is designed in accordance with the present invention and which is generally designated by the reference numeral 10. As will be described in more detail hereinafter, this combination arrangement includes and preferably consists solely of a cosmetic container 12 and a support tab 14. The container is adapted to house a cosmetic therein, as discussed above, and the support tab serves as a package for the container and, at the same time, a means of supporting the container to a display or shelf rack which is at least partially represented by the upstanding post 16 and its associated hook 18. As will be seen below, container 12 is interlocked in place within a cooperating cutout in tab support 14 and cannot be removed without being opened first. At the same time, the entire front face of the container remains uncovered and in direct view for visual inspection by potential customers.

Figure 3:
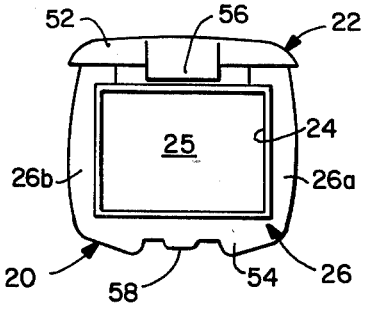
FIG. 3 is a top plan view of the opened container.

Referring now to FIGS. 2–5, attention is specifically directed to container 12 which is shown including a generally rectangular main section 20 and a similarly shaped lid 22. As best seen in FIG. 3, main section 20 defines a compartment 24 which houses a cosmetic, for example blush, eye shadow, lipstick, or the like, generally indicated at 25. Main section 20 also includes a circumferential margin or edge 26 extending entirely around compartment 24. As seen best in FIG. 4, lid 22 includes a similar margin or edge 28 defining most of its rectangular periphery. In the embodiment illustrated, this margin or edge extends around a centrally located clear window 30 which, as will be seen below, exposes the cosmetic 26 to view when the lid is closed against main section 20.

Figure 4:
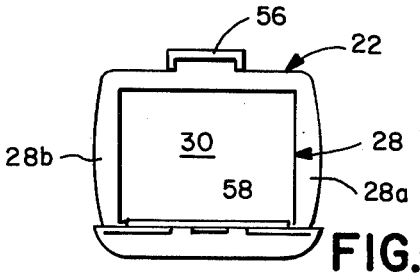
FIG. 4 is a front elevational view of the opened container.
Figure 5:
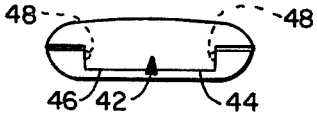
FIG. 5 is a back elevational view of the container when the latter is in its closed position.

Lid 22 is pivotally connected along its back edge 32 to the back edge 40 of main section 20 by a cooperating hinge mechanism generally indicated at 42 in FIG. 5. As seen in this latter figure, the hinge mechanism includes an elongated hinge element 44 depending from a central location along the length of back edge 32 of lid 22. The back edge 40 of main section includes a complementary slot for receiving element 44 and opposing pivot projections 48 extending into cooperating openings at the opposite ends of element 44. In this way, the lid is pivotally movable between its opened position illustrated in FIGS. 2–4 and its closed position illustrated in FIGS. 1 and 5. While a hinge mechanism could be provided to bias lid 22 in its closed position, the overall container preferably includes a suitable latching mechanism to maintain the lid in a disengagably closed position. This mechanism which is generally indicated at 50 in FIG. 1 extends along and forms part of the front edges 52 and 54 of the lid and container main section, respectively, as best seen in FIGS. 3 and 4. As seen in these latter figures, the hinge mechanism includes interlocking tabs 56 and 58.

From the foregoing, it should be apparent that the circumferential margin or edge 26 on the top side of container section 20 and the circumferential margin or edge 28 on the underside of lid 22 engage one another when the lid is closed. As will be seen hereinafter, these engaging margins or edges and specifically opposite sections thereof are used to interlock the overall container with support tab 14 when the container is disposed within a cooperating cutout which is formed in the tab and which will be described below.

Figure 6:
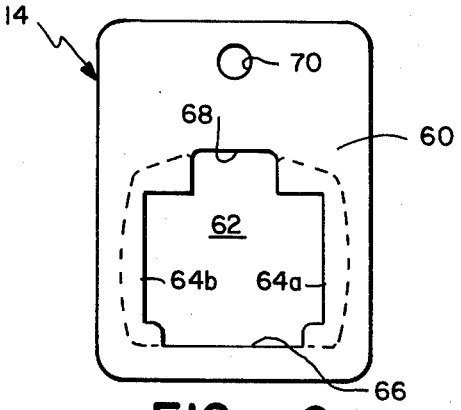
FIG. 6 is a front elevational view of a support tab comprising part of the combination arrangement illustrated in FIG. 1.

Referring now to FIG. 6, attention is directed to the details of tab 14. As seen in this figure, the tab includes a generally rectangular, sheet-like main body 60 which may be cardboard, plastic, sheet metal, metal foil or like sheet material having sufficient structural integrity to support container 12 in the manner to be described. Main body 60 includes a generally rectangular cutout 62 which is configured to accommodate the container in an interlocking manner when the container lid is closed. This is best illustrated in FIGS. 7 and 8 in conjunction with FIGS. 1 and 6. As seen in FIG. 7, with the container in place within cutout 62, main section 20 is disposed on the back side of tab body 60 such that opposite edge sections 26*a* and 26*b* of edge 26 rest against the back sides of opposite edge sections of the tab body 60 along and on opposite sides of cutout 62. These latter edge sections are generally indicated by dotted lines at 64*a* and 64*b* in FIG. 6. At the same time, lid 22 is located on the front side of tab body 60, as best seen in FIG. 8. The margin or edge sections 28*a* and 28*b* of margin 28 engage the front sides of edges 64*a* and 64*b*. In this way, the container cannot be removed from cutout 62 without opening the container. In fact, in order to initially position the container in cutout 62 in the manner just described, the container lid must be opened and either the lid or main section must be passed through the cutout before the lid can be closed. Once the opened container is positioned within the cutout in this way, the lid is pivotally moved to its closed position. In this regard, the cutout itself includes a bottom cutout segment 66 (FIG. 6) adapted to receive hinge mechanism 42 such that the tab body does not interfere with operation of the hinge mechanism. For the same reason, cutout 62 includes a top cutout segment 68 adapted to receive the latch mechanism 50, that is, so that the tab body does not interfere with its operation. At the same time, these cutout segments serve to properly align the container in place.

It should be apparent from the foregoing that the overall configuration of cutout 62 in tab body 60 depends upon the overall configuration of container 12 and therefore may vary depending upon the configuration of its associated container. Nevertheless, the cutout configuration selected must be one which allows at least one edge section of the tab body along the cutout to extend into the container between its main section and lid when the latter is closed for locking the container in place. The cutout is preferably configured so that at least two opposing edge sections of the tab body extend into the container when the latter is closed. Obviously, in any of the configurations selected, the container must be allowed to be opened and closed within the cutout. In the case of a hinged and latching lid, the hinge and latching mechanisms must be allowed to function in their intended manner. Moreover, the container itself must be one which lends itself to this overall interlocking relationship with the tab body.

Having described the way in which tab body 60 supports its associated container 12, attention is now directed to the way the entire arrangement is supported on hook 18 of post 16 in FIG. 1. All that is necessary to accomplish this is to provide the tab body with a through-hole 70 which is preferably located directly above cutout 62. This through-hole receives the hook 18 or any other shelf type peg in the manner illustrated in FIG. 1. In this regard, note that the entire front face of the container remains uncovered and in direct view for inspection by potential customers. This includes window 30 which readily displays the cosmetic therein.

What is claimed is:

1. A combination container and support arrangement, comprising: a container including a generally rectangular main section defining a compartment adapted to house a cosmetic therein, a generally rectangular lid, pivot means connecting said lid to said main section for pivotal movement between an opened position and a closed position whereby to gain access to or close off said compartment, and latching means for disengagably maintaining said lid in its closed position; and a support tab having a sheet-like, planar main body which includes a cutout inwardly of its outer periphery and configured to accommodate said container including said pivot and latching means and a through-hole adapted to receive a shelf peg or the like for supporting the overall arrangement; said container with its lid closed being disposed within said cutout and entirely within the confines of the outermost periphery of said tab body such that two planar edge sections of said main body along said cutout extend into and between said main section and closed lid for locking said container in place within said cutout so long as said lid remains closed whereby direct access can be made into said compartment while the container remains in said cutout by merely opening said lid, thereby allowing a user or potential user to inspect or even use the cosmetic within said compartment without having to remove the container from said cutout, said cutout including cutout segments which respectively receive said pivot and latching means so that the latter are free to function without interference from the support tab, said cutout being generally rectangular with said cutout segments being disposed on opposite ends of said cutout, said edge sections of said main body extending on opposite sides of said cutout between said cutout segments.

2. A combination arrangement according to claim 1 wherein said lid includes a window through which said cosmetic within said container compartment is visible when said container is locked in place within said cutout whereby the cosmetic within said compartment can be viewed directly through said window without removing said container from said cutout.

* * * * *